US007789551B2

(12) United States Patent
Ray et al.

(10) Patent No.: US 7,789,551 B2
(45) Date of Patent: Sep. 7, 2010

(54) DEVICES FOR BLENDING MATERIALS AND BAGS AND FOR USE IN SUCH DEVICES

(76) Inventors: Stuart John Ray, 94 Hornsey Lane, London (GB) N1 5LT; Graham Roger Gibbins, 8 Claypit Road, Foulsham, Dereham, Norfolk (GB) NR20 5RW ( * ) Notice: Subject to any disclaimer, the term of this patent is extended or adjusted under 35 U.S.C. 154(b) by 1034 days.

(21) Appl. No.: 10/598,675

(22) PCT Filed: Mar. 7, 2005

(86) PCT No.: PCT/GB2005/000867

§ 371 (c)(1),
(2), (4) Date: Sep. 7, 2006

(87) PCT Pub. No.: WO2005/084787

PCT Pub. Date: Sep. 15, 2005

(65) Prior Publication Data

US 2007/0140047 A1 Jun. 21, 2007

(30) Foreign Application Priority Data

Mar. 8, 2004 (GB) ..... 0405173.6
Mar. 8, 2004 (GB) ..... 0405188.4

(51) Int. Cl.
*B01F 11/00* (2006.01)

(52) U.S. Cl. ..... 366/108; 366/275; 141/77

(58) Field of Classification Search ..... 366/108, 366/275; 141/75–77
See application file for complete search history.

(56) References Cited

U.S. PATENT DOCUMENTS

| | | | | | |
|---|---|---|---|---|---|
| 2,336,438 | A | * | 12/1943 | Evans | 366/108 |
| 2,863,475 | A | * | 12/1958 | Lau | 141/77 |
| 3,819,158 | A | * | 6/1974 | Sharpe et al. | 366/349 |
| 4,049,242 | A | | 9/1977 | Porter et al. | |
| 6,267,498 | B1 | | 7/2001 | Lafond et al. | |
| 6,416,212 | B1 | * | 7/2002 | Rogers et al. | 366/117 |
| 6,439,759 | B1 | * | 8/2002 | Ray et al. | 366/197 |
| 2003/0031085 | A1 | | 2/2003 | Baron | |

FOREIGN PATENT DOCUMENTS

| | | |
|---|---|---|
| GB | 1402538 | 9/1975 |
| WO | 9728053 | 8/1997 |

* cited by examiner

*Primary Examiner*—David L Sorkin
(74) *Attorney, Agent, or Firm*—Faegre & Benson LLP

(57) ABSTRACT

A device for blending materials and a bag for use in such devices. The device has at least one paddle for acting on a sample and a carrier against which a sample may be crushed by the paddle. The device is arranged to allow adjustment of the spacing between the paddle and carrier during operation. The bag is suitable for use in such a device but can be used in other devices.

28 Claims, 4 Drawing Sheets

DEVICES FOR BLENDING MATERIALS AND BAGS AND FOR USE IN SUCH DEVICES

BACKGROUND OF THE INVENTION

This invention relates to devices for blending materials and bags for use in such devices. The materials to be mixed or blended may be liquids or semi-liquid matter, and in some cases solids, powders or even gases. The invention is particularly concerned with the preparation of samples for bacteriological or chemical testing.

There are existing blending devices comprising a door which acts as a support for holding a sample bag and two reciprocating paddles for acting on the bag. A bag may be placed on the support and then brought into an operating position (by closing the door of the device) to clamp in position and seal the bag. The paddles are arranged to reciprocate, alternately pressing on the outer surface of the bag, kneading the contents of the bag to achieve a blending action. The paddles reciprocate over a fixed range of motion and the support can be positioned so that there is always an appropriate gap in which the bag may sit during blending. The minimum gap between the paddles and the support during blending can be termed the "paddle clearance".

During the time that blending devices of the type described above have been on the market, techniques for analyzing samples in the fields of bacteriological and chemical testing have improved. As a result of these improvements scientists now often work with smaller samples.

In general, when working with smaller samples, a smaller paddle clearance is required. Otherwise, the paddles either fail to make contact with the bag or make insufficient contact to achieve effective blending of the contents of the bag. The result of this is that smaller samples may remain unblended.

When working with smaller samples there is also a problem in obtaining a useful blended sample. For example, a conventional bag sold for use with a blending device marketed by the applicants is designed to hold between 5 ml and 80 ml of liquids—with such sized samples, good results are achieved. However, it has been found that if 250 μl of liquid is used in this conventional bag, the result can be that you merely end up with the inside of the bag becoming wet. It can be difficult or impossible to extract a useful sample of the liquid.

It is an object of the present invention to alleviate at least some of the problems associated with the prior art.

According to a first aspect of the present invention there is provided a device for blending materials comprising a carrier support arranged to support a closed bag containing material to be blended, at least one reciprocating kneading paddle having an extended position and being arranged to apply a kneading action to the walls of a supported bag for homogenizing its contents, and adjustment means for controllably varying a spacing between the paddle when in its extended position and the carrier support.

Such an arrangement can facilitate the blending of differently sized samples. Thus, for example a device can be used for blending conventional 5 ml to 80 ml samples and for much smaller samples. Moreover the provision of adjustment means, means that it is a simple matter for a user to change the spacing between the paddle and carrier support (change the paddle clearance) for different sized samples.

Typically, the adjustment means comprises a user operable control for use in varying the spacing. The user operable control may comprise a knob which is rotatable by the user to vary the spacing.

Preferably the adjustment means is arranged so that the spacing may be varied during operation of the device. This means that the process of blending a sample may be begun and the pressure exerted on the bag, and sample, changed during the blending process.

Preferably the adjustment means comprises a cam arrangement for varying the spacing between the extended paddle position and the carrier support.

Because of the continual operation of the paddles when the device is in use and the forces exerted between the paddles and the carrier support, the adjustment mechanism needs to be robust. For this reason a cam arrangement is favored over use of a lead screw or some other threaded component, which is more likely to wear or jam over time.

The cam arrangement may comprise a pair of interacting cam portions whose cam surfaces face one another. A first of the cam portions may be mounted against rotation in the device and a second of the cam portions may be mounted in the device for rotation relative to the first cam portion. The cam portions may be arranged so that relative rotation of the pair of cam portions causes a spacing between their respective mounting points to change.

The second cam portion may be rotatable by rotation of the user operable control.

The device may comprise a backing portion on which the carrier support is mounted. The carrier support may be arranged for movement relative to the backing portion to change the spacing between the paddle when in its extended position and the carrier support. One of the cam portions may be mounted on the carrier support and the other of the cam portions may be mounted on the backing portion such that relative rotation of the cam portions causes the spacing between the carrier support and the backing portion to change, thus changing the spacing between the paddle when in its extended position and the carrier support.

Preferably the device comprises a door which comprises the backing portion, the carrier support and the adjustment means. The backing portion may comprise the outer surface of the door. The user operable control may be provided at the outer surface of the door.

Where the user operable control is a knob this may be mounted to the second cam portion and protrude through the backing portion. Thus in the case where the backing portion comprises the outer surface of the door, the knob for adjusting the paddle clearance may be provided on the door.

According to a second aspect of the present invention there is provided a sample bag comprising a generally triangular sample holding portion.

The generally triangular shape of the sample holding portion allows easier collection of the sample after blending. When the blending process is complete, a user may grasp the bag and, using his thumb and forefinger (or otherwise), drag the dispersed sample to an apex of the triangle. Once the sample has been collected in an apex of the triangle, a pipette tip may be inserted into the bag to collect the sample from the corner. This method results in minimal loss of sample.

Here what is important is that there is a collecting zone for the sample. Thus the expression generally triangular should be interpreted broadly, for example, the triangle could have curved sides.

According to another aspect of the present invention there is provided a sample bag comprising a sample holding portion that comprises a sample collecting portion. The sample collecting portion should preferably be small compared to the size of the bag.

According to yet another aspect of the present invention there is provided a sample bag comprising a sample holding portion and sealing means for sealing the sample holding portion until use.

The sealing means may comprise a closure portion that may be removed to allow access to the sample holding portion.

The sample bag may comprise a pair of generally rectangular sheets which may be sealed together by a pair of seal lines to form the generally triangular sample holding portion.

There may be further seal lines between the pair of sheets, although often such additional lines will serve no useful function.

A seal line may be provided to seal the sample holding portion until use. Said seal line may be provided between the pair of seal lines forming the generally triangular sample holding portion, so forming a triangular sample receiving portion sealed against the ingress of material. Said seal line may be provided in a closure portion.

To use the bag, the user may tear or cut the closure portion away from the remainder of the bag to allow access to be obtained to the interior of the sample holding portion.

One or more seal line may be applied to a generally rectangular bag to form the sample holding portion, and a further seal line may be applied to seal the sample holding portion until use.

The sample bag may be a paddle blender sample bag.

According to a third aspect of the present invention there is provided a method of preparing a sample comprising the steps of:

a. placing material in a sample bag comprising a generally triangular sample holding portion;

b. blending the material; and c. extracting a sample from the bag by squeezing the bag to cause at least some of the contents to collect in an apex of the generally triangular sample holding portion and extracting the collected contents from the apex of the sample holding portion.

According to a fourth aspect of the invention there is provided apparatus comprising a device according to the first aspect of the present invention and a bag according to the second aspect of the present invention wherein the width of the bag is substantially the same as the width of a paddle in the device which is arranged to contact the bag for blending of the contents.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF THE DRAWINGS

A blending device and a bag for use therewith which embody the present invention are now described, by way of example only, with reference to the accompanying drawings in which.

DETAILED DESCRIPTION OF THE PREFERRED EMBODIMENTS

Figure 1:
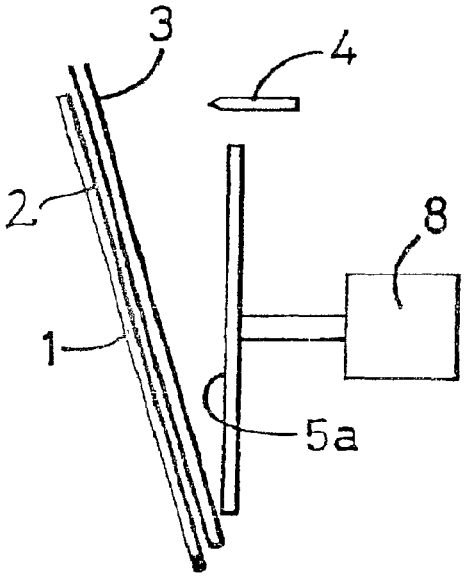
FIG. 1 (PRIOR ART)
FIG. 1 is a simplified schematic side view of a blending device being loaded.
Figure 2:
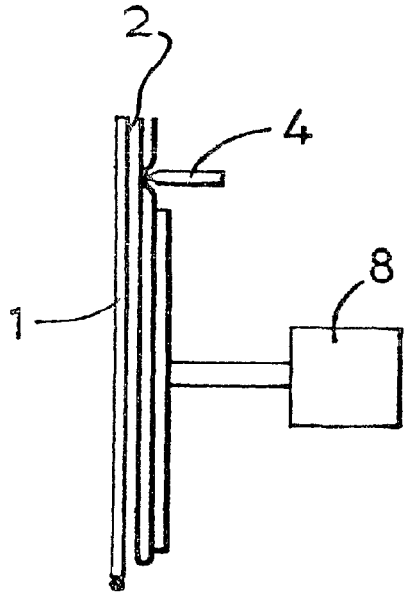
FIG. 2 (PRIOR ART)
FIG. 2 is a simplified schematic side view of the blending device shown in FIG. 1 when loaded.
Figure 3:
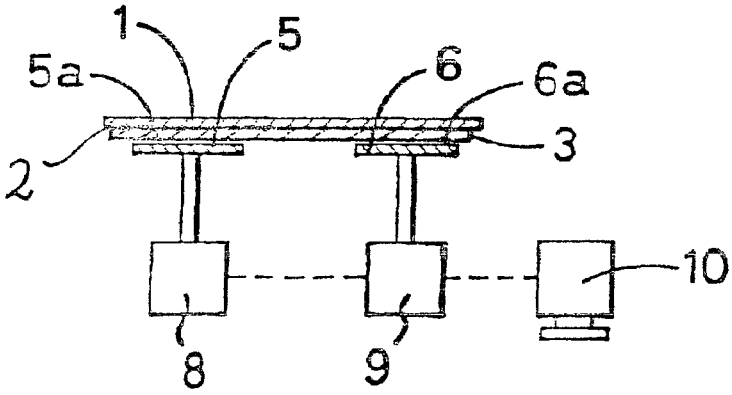
FIG. 3 (PRIOR ART)
FIG. 3 is a simplified sectional view of the blending device shown in FIGS. 1 and 2 which shows paddles and a drive mechanism of the device.

FIGS. 1 to 3 show basic features of a blending device in schematic form only and details of the device embodying the invention have been omitted from these Figures for the sake of clarity.

At this basic level the device comprises a door 1 which is pivotable about a hinge provided at one end and comprises a carrier support 2 for supporting a bag 3 containing a sample to be blended. Clamping sealing means 4 is provided to hold the bag 3 and to provide a seal prior to and during operation of the device. In this embodiment a kneading means which comprises a first and second paddles 5,6 is provided. The first paddle 5 has an associated driving means 8 for reciprocatingly driving the first paddle 5 in a direction which is substantially perpendicular to the kneading surface 5*a* of the first paddle 5. Similarly, a second driving means 9 is provided for reciprocatingly driving the second paddle 6 in a direction which is substantially perpendicular to a kneading surface 6*a* of the second paddle 6. A common motor 10 provides the power for both of the driving means 8, 9 which are each in the form of transmission gearing arrangements.

The door 1 is pivotable about the hinge between an open position in which a sample bag 3 can be loaded (see FIG. 1) and a closed position in which a sample bag is brought into contact with the clamping sealing means 4, so sealing the bag 3 (see FIG. 2). Further in the closed position, the bag 3 and the material contained therein are brought into contact with the kneading surfaces of the first and second paddles 5, 6.

FIG. 3 shows the paddles 5, 6 in line at an equal distance from the carrier support 2. In use the paddles 5, 6 are driven out of phase. Thus operation of the machine, starting from the configuration shown in FIG. 3, will cause one paddle 5 to move towards the support 2, and one paddle 6 to tend to move away from the support 2. At the extremes of the reciprocating motion, the paddle nearest to the support 2 will be separated from the support 2 by a paddle clearance.

The reciprocation of the paddles 5, 6 tends to crush the sample in the bag 3 and to push the sample around the bag 3 causing the sample to be blended.

There are various different configurations of paddles that may be used in such devices and different drive patterns that may used. Thus, for example there may be a single paddle, the or each paddle may be rectangular or specially shaped to encourage circulation of the contents, there may be more than two paddles, paddles may be driven in phase, island baffles may be provided between paddles and so on.

In the present embodiment an important feature is the facility for adjusting the paddle clearance. In the present embodiment this adjustment facility is provided by a mechanism provided in the door 1, details of which are omitted from FIGS. 1 to 3 but which are shown in FIGS. 4 to 6.

Figure 4:
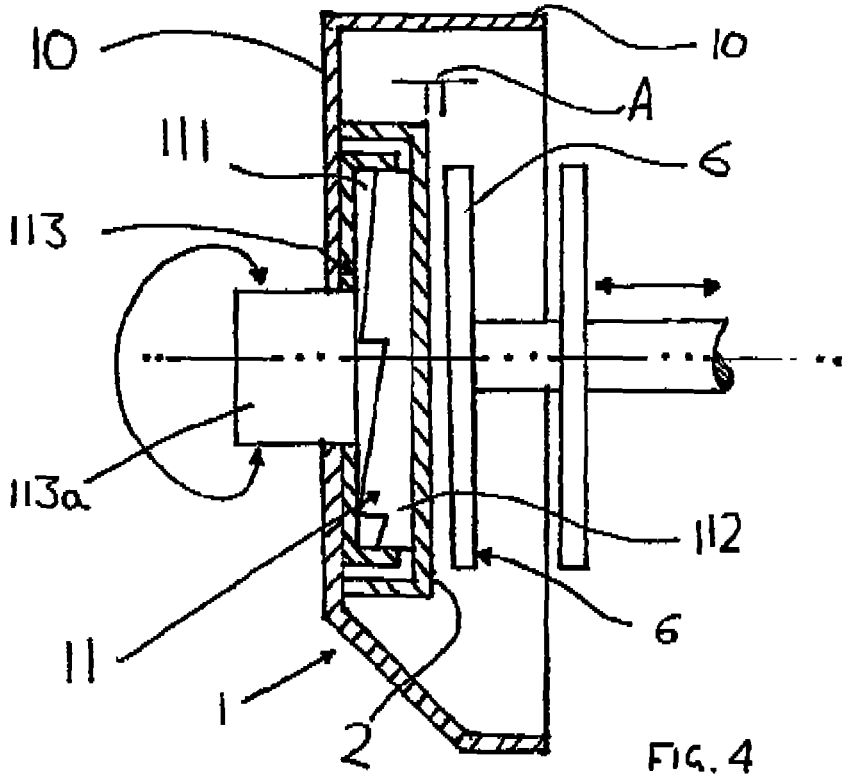
FIG. 4 shows a door of the device of FIGS. 1 to 3 in more detail, partly in section, and with the carrier support in a withdrawn position.
Figure 5:
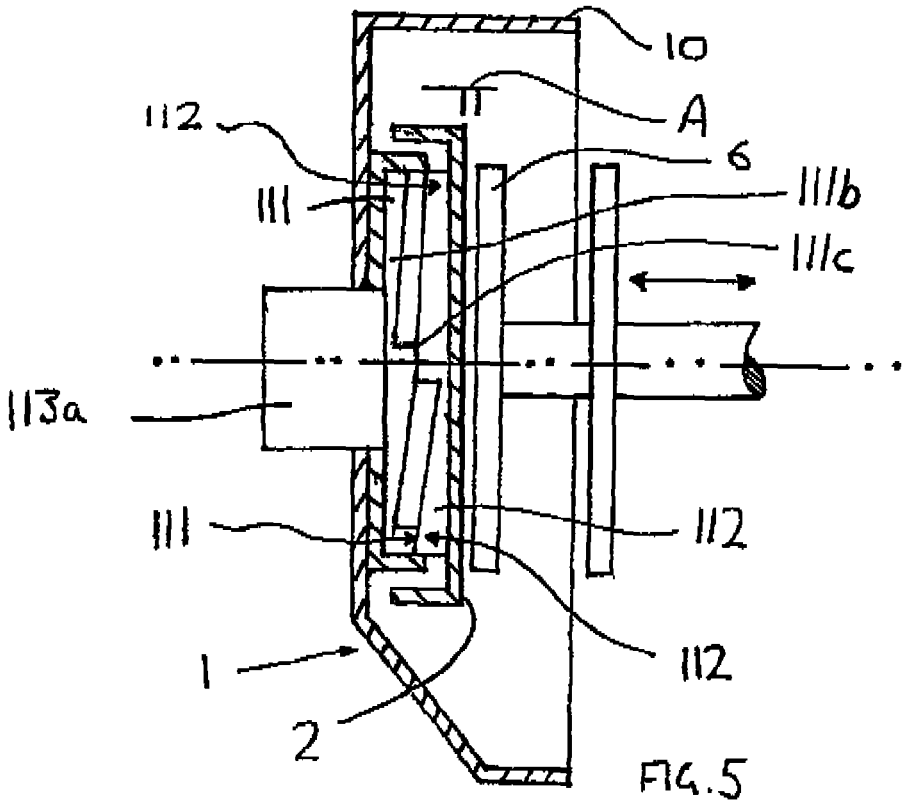
FIG. 5 shows the door shown in FIG. 4 but with the carrier support in an extended position.
Figure 6:
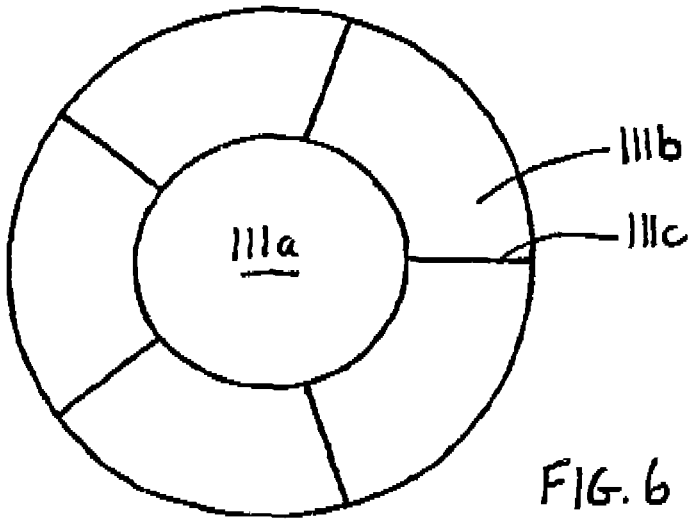
FIG. 6 is a plan view of one of the cam portions included in an adjustment mechanism of the device shown in FIGS. 1 to 5.

FIGS. 4 and 5 show a section through the door1 to make the adjustment mechanism visible. The section is taken to one side of the adjustment mechanism such that the adjustment mechanism is shown in elevation rather than section. The door 1 comprises an outer plate 10 within which is mounted the carrier support 2. When the door 1 is moved in to the closed position (corresponding to the position in FIG. 2), the outer plate 10 engages with a main casing of the blending device (not shown) and the support 2, bag 3 and paddles 5,6 are enclosed.

The carrier support 2 is arranged for movement relative to the outer plate 10 of the door via operation of a cam arrangement 11. It will be seen that movement of the carrier support 2 towards and away from the outer plate 10 of the door causes the paddle clearance A to change. FIG. 4 shows the carrier support 2 in a withdrawn position (maximum paddle clearance) and FIG. 5 shows the carrier support 2 in an extended position (minimum paddle clearance).

The cam arrangement 11 comprises a outer cam portion 111 and a inner cam portion 112 which are provided with their respective cam surfaces facing one another and retained in contact with one another.

The inner cam portion 112 is mounted to the carrier support 2 on a surface which is opposite that which is for supporting an inserted bag 3. The inner cam portion 112 is fixed against rotation.

The outer cam portion 111 is mounted in a cam portion housing 113. The housing 113 comprises a knob 113*a*, which projects through an aperture formed in the outer plate 110 of the door 1. The cam portion housing 113 is mounted for rotation relative to the outer plate 110 of the door 1 and the outer cam portion 111 is mounted so as to rotate with the cam portion housing 113.

Thus the outer cam portion 111 is arranged for rotation relative to the inner cam portion 112. Furthermore the cam surfaces on the two cam portions 111, 112 are arranged so that relative rotation between the cam portions 111,112 from a start position causes the cam portions 111,112 to be driven apart.

Therefore, rotation of the knob 113*a* by a user causes the carrier support 2 to move relative to the outer plate 10 of the door and hence changes the paddle clearance. It should be noted that the paddle clearance may be adjusted from the exterior of the device—i.e., by operation of the knob 113*a* and that the paddle clearance can be adjusted during operation of the device if required. Furthermore, within the range of adjustment provided, the paddle clearance may be varied continuously.

FIG. 6 shows a plan view of the cam surface of the inner cam portion 111. In this embodiment the cam surfaces of the two portions 111,112 are substantially the same.

However, to give cam adjustment it will be clear that all that is required is the provision of interacting surfaces which allow a user to change the separation between components by movement of these surfaces relative to one another. Thus the movement might be linear rather than rotary and there may be a single cam portion and an appropriate following portion. However rotary movement is preferred, as is the provision of a pair of interacting cam portions. Even in such a case the cam portions need not have the same or similar cam surfaces, they merely need to interact to give the desired separation effect.

The surface of the inner cam portion 111 comprises a flat circular portion 111*a* having no camming function and a rim portion 111*b*. The rim portion 111*b* varies in height around the circumference of the inner cam portion 111 reaching five peaks 111*c* to form a saw tooth like profile (the side of the rim portion 111*b* can be seen in FIGS. 4 and 5). Progressing clockwise around the rim 111*b* of the inner cam portion 111, the rim 111*b* ramps up to a peak 111*c* before dropping sharply and then ramping up to the next peak.

It will be appreciated that differing numbers of peaks and differing cam profiles may be chosen to give different effects. It has in fact been found that the use of three ramp like portions with three respective peaks is particularly effective. Although not shown in the drawings, in the present embodiment stop means are provided to prevent a user turning the knob such that the cam surfaces jump of the end of respective peaks causing a collapse of the carrier support towards the outer plate of the door 1. The stop position can be chosen to keep a desired minimum zone of contact between the facing cam surfaces.

With the carrier support 2 in the withdrawn position, shown in FIG. 4, the profiled surfaces of the inner and outer cam portions 111, 112 are substantially aligned so that there is near complete contact. In this configuration the carrier support 2 is positioned as far away from the paddles 5, 6 as the blending device will permit with the door 1 closed.

With the carrier support in the extended position, shown in FIG. 5, the profiled surfaces of the inner and outer cam portions 111, 112 are substantially out of line and the surfaces are only in partial contact. In this configuration the carrier support 2 is disposed as near to the paddles 5, 6 as the blending device will permit with the door 1 closed.

Alternative embodiments may be constructed so that when the carrier support 2 is in the extended position there is effectively a zero paddle clearance, allowing the user to select as small a clearance as desired. Further, of course the paddle clearance may be adjusted in use.

Many different types of sample bags may be used with devices of the general type described above.

Figure 7:
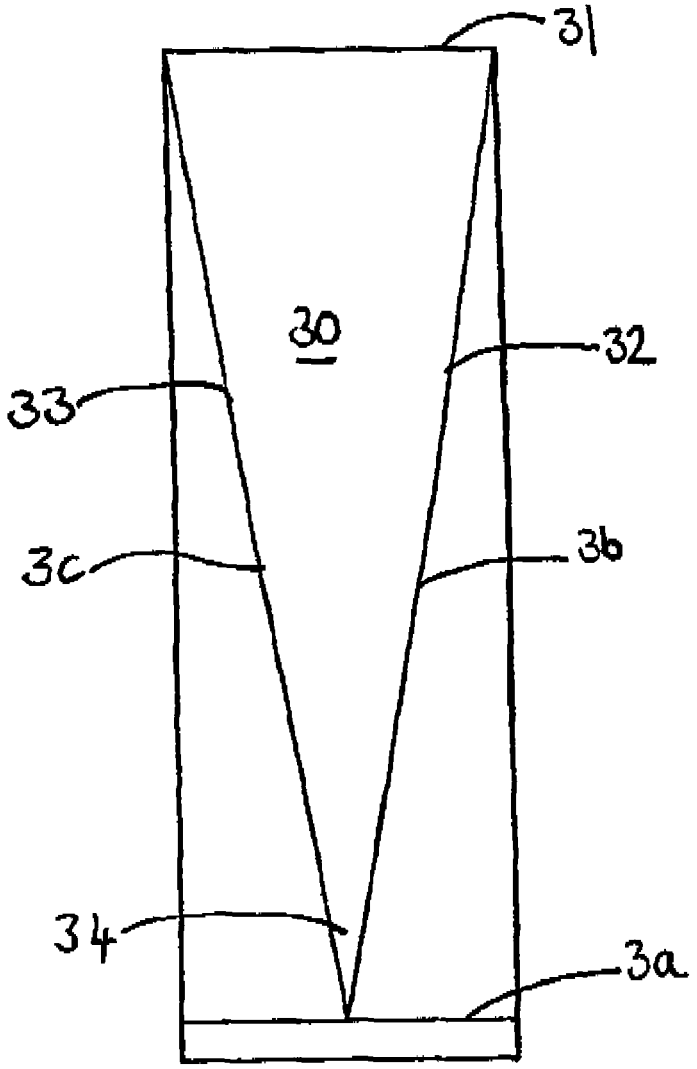
FIG. 7 shows a sample bag that, amongst other things, may be used in the blending device shown in FIGS. 1 to 5.

FIG. 7 shows a preferred type of bag 3 for processing small samples. The bag 3 is formed of two pieces of rectangular plastic which are sealed together. A first seal line 3*a* across a short edge of the rectangular plastic sheets forms a sealed end of the bag 3. Two additional seal lines 3*b* and 3*c* originate from a point (in this embodiment—the centre) on the first seal line 3*a* and are inclined away from one another to form a triangular receiving portion 30 into which material may be placed. The open edge 31 of the triangular receiving portion 30 is shorter than the other two sides 32 and 33, which are of equal length. The receiving portion 30 has an apex 34 which acts as a collecting zone located adjacent to the seal line 3*a* at the closed end of the bag 3.

When the bag 3 is placed in a blending device of the type described above and the door 1 is closed, the clamping sealing means 4 seals the receiving portion 30.

A sample may be readily inserted into the bag 3 via the open edge 31. The sample may then be blended using the blending device as described above. After blending has been completed a user may grasp the bag 3 and, using his thumb and forefinger (or otherwise) drag the dispersed sample to the apex 34 of the receiving portion 30. Once the sample has been collected in the apex 34, a pipette tip may be inserted into the receiving portion 30 to collect the sample from the apex 34. This method results in minimal loss of sample.

It will be seen that other generally triangular shaped receiving portions may be provided to similar effect—for example there may be curved seal lines.

Besides the seal lines mentioned above there may be other seal lines between sheets of plastic making up the bag. One or more seal line may be added to a conventional rectangular sample bag to give the desired receiving portion 30. In such a case a single diagonal sealing line could provide a triangular receiving portion with one of the existing edges of the bag giving the other edge of the receiving portion.

The bag may be dimensioned so as to closely match the size of the kneading surface 5*a*,6*a* of one of the paddles 5,6 of the blending device. Where the kneading surface 5*a*,6*a* is rectangular, this rectangle may be of the same size and shape as that of the sample bag.

Figure 8:
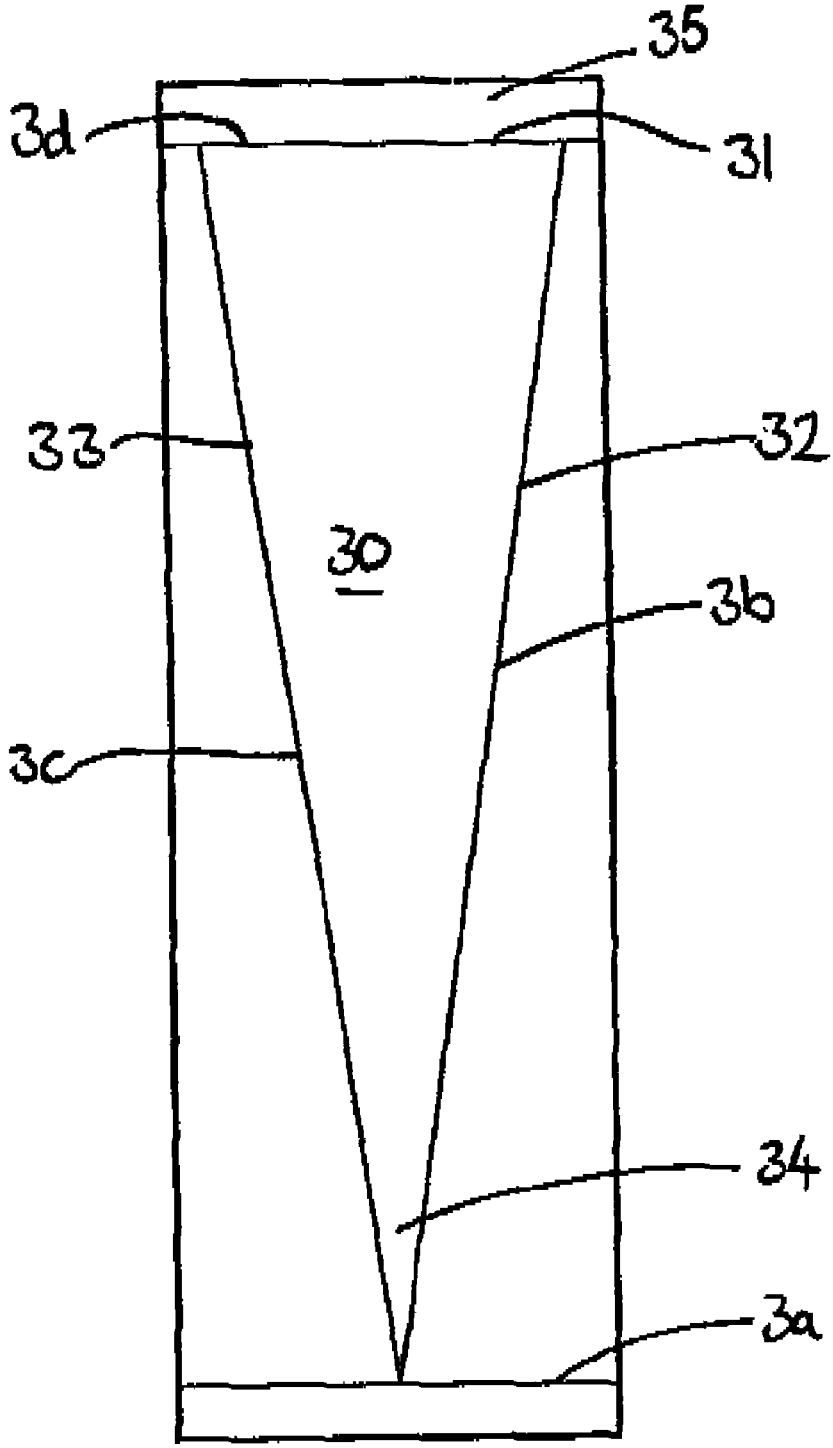
FIG. 8 shows an alternative sample bag.

FIG. 8 shows an alternative sample bag that is similar to that shown in FIG. 7 and the same reference numeral have been used to designate corresponding features. In this alternative sample bag a closure portion 35 is provided which is separated from the sample receiving portion by a further seal line 3*d*. This further seal line 3*d* serves to seal the receiving portion 30 against the ingress of material until use. When it is desired to use the bag 3, the user can cut or tear off the closure portion 35 or otherwise cut the bag to allow access to the interior of the sample receiving portion 30. This can help in keeping the interior of the bag 3 sterile until use. It will be seen that, until use, the receiving portion 30 is a sealed triangular pocket or chamber formed between the two sheets of plastics material making up the bag 3.

What is claimed is:

1. A device for blending materials comprising:

a carrier support arranged to support a closed bag containing material to be blended;

at least one reciprocating kneading paddle having an extended position and being arranged to apply a kneading action to the walls of a supported bag for homogenizing its contents; and an adjustor for controllably varying a spacing between the paddle when in its extended position and the carrier support, wherein the adjustor comprises a cam arrangement for varying the spacing between the extended paddle position and the carrier support.

2. A device according to claim 1 in which the adjustor comprises a user operable control for use in varying the spacing.

3. A device according to claim 2 wherein the user operable control comprises a knob which is rotatable by the user to vary the spacing.

4. A device according to claim 1 in which the adjustor is arranged so that the spacing is variable during operation of the device.

5. A device according to claim 1 in which the cam arrangement comprises a pair of interacting cam portions whose cam surfaces face one another.

6. A device according to claim 5 in which a first of the cam portions is mounted against rotation in the device and a second of the cam portions is mounted in the device for rotation relative to the first cam portion.

7. A device according to claim 6 in which the adjustor comprises a user operable control and the second cam portion is rotatable by operation of the user operable control.

8. A device according to claim 5 in which the cam portions are arranged so that relative rotation of the pair of cam portions causes a spacing between their respective mounting points to change.

9. A device according to claim 1 in which the device comprises a backing portion on which the carrier support is mounted.

10. A device according to claim 9 in which the carrier support is arranged for movement relative to the backing portion to change the spacing between the paddle when in its extended position and the carrier support.

11. A device according to claim 10 in which cam arrangement comprises a pair of interacting cam portions whose cam surfaces face one another and one of the cam portions is mounted on the carrier support and an other of the cam portions is mounted on the backing portion such that relative rotation of the cam portions causes the spacing between the carrier support and the backing portion to change, thus changing the spacing between the paddle when in its extended position and the carrier support.

12. A device according to claim 11 in which the adjustor comprises a user operable control which control comprises a knob which is mounted to the other of the cam portions and protrudes through the backing portion.

13. A device according to claim 9 in which the device comprises a door which comprises the backing portion, the carrier support and the adjustor.

14. A device according to claim 13 in which the backing portion comprises the outer surface of the door.

15. A device according to claim 13 in which the adjustor comprises a user operable control and the user operable control is provided at the outer surface of the door.

16. A device according to claim 15 in which the control comprises a knob for adjusting the paddle clearance which is provided on the door.

17. An apparatus comprising a device according to claim 1 and a sample bag comprising a generally triangular sample holding portion wherein a width of the bag is substantially the same as a width of a paddle in the device which is arranged to contact the bag for blending of the contents.

18. A device for blending materials comprising:

a carrier support arranged to support a closed bag containing material to be blended;

at least one reciprocating kneading paddle having an extended position and being arranged to apply a kneading action to the walls of a supported bag for homogenizing its contents; and adjustment means for controllably varying a spacing between the paddle when in its extended position and the carrier support wherein the adjustment means is arranged so that the spacing is variable during operation of the device, wherein the adjustment means comprises a cam arrangement for varying the spacing between the extended paddle position and the carrier support.

19. A device for blending materials comprising:

a carrier support arranged to support a closed bag containing material to be blended;

at least one reciprocating kneading paddle having an extended position and being arranged to apply a kneading action to the walls of a supported bag for homogenizing its contents; and an adjustor for controllably varying a spacing between the paddle when in its extended position and the carrier support, wherein the device comprises a backing portion on which the carrier support is mounted, and wherein the carrier support is arranged for movement relative to the backing portion to change the spacing between the paddle when in its extended position and the carrier support.

20. A device according to claim 19 in which the adjustor comprises a user operable control for use in varying the spacing.

21. A device according to claim 20 wherein the user operable control comprises a knob which is rotatable by the user to vary the spacing.

22. A device according to claim 19 in which the adjustor is arranged so that the spacing is variable during operation of the device.

23. A device according to claim 19 in which the device comprises a door which comprises the backing portion, the carrier support and the adjustor.

24. A device according to claim 23 in which the backing portion comprises the outer surface of the door.

25. A device according to claim 23 in which the adjustor comprises a user operable control and the user operable control is provided at the outer surface of the door.

26. A device according to claim 25 in which the control comprises a knob for adjusting the paddle clearance which is provided on the door.

27. An apparatus comprising a device according to claim 19 and a sample bag comprising a generally triangular sample holding portion wherein a width of the bag is substantially the same as a width of a paddle in the device which is arranged to contact the bag for blending of the contents.

28. A device for blending materials comprising:

a carrier support arranged to support a closed bag containing material to be blended;

at least one reciprocating kneading paddle having an extended position and being arranged to apply a kneading action to the walls of a supported bag for homogenizing its contents; and adjustment means for controllably varying a spacing between the paddle when in its extended position and the carrier support wherein the adjustment means is arranged so that the spacing is variable during operation of the device, wherein the device comprises a backing portion on which the carrier support is mounted, and wherein the carrier support is arranged for movement relative to the backing portion to change the spacing between the paddle when in its extended position and the carrier support.

* * * * *